United States Patent [19]

Barnett

[11] Patent Number: 4,709,891

[45] Date of Patent: Dec. 1, 1987

[54] SUPPORT BRACKET FOR SIGNS AND ADVERTISING DISPLAYS

[75] Inventor: Earl D. Barnett, Morton Grove, Ill.

[73] Assignee: Chicago Show Printing Co., Morton Grove, Ill.

[21] Appl. No.: 815,540

[22] Filed: Jan. 2, 1986

[51] Int. Cl.[4] ..... G09F 3/18

[52] U.S. Cl. ..... 248/214; 248/231.7; 248/295.1

[58] Field of Search ..... 248/497.2, 231.7, 295.1, 248/214

[56] References Cited

U.S. PATENT DOCUMENTS

| | | | |
|---|---|---|---|
| 579,735 | 3/1897 | Bower | 248/231.7 |
| 646,835 | 4/1900 | Jackson | 248/231.7 |
| 1,867,276 | 7/1932 | McIntyre | 248/231.7 |
| 2,628,051 | 2/1953 | Anderson | 248/231.7 |
| 2,835,994 | 5/1958 | Kuefner | 47/47 |
| 2,898,069 | 8/1959 | Kramer | 248/231.7 |
| 3,262,666 | 7/1966 | Solum | 248/231.7 |
| 3,664,626 | 5/1972 | Sneller | 248/214 |
| 4,138,019 | 2/1979 | Smith | 248/214 |
| 4,301,767 | 11/1981 | Willinger | 248/214 |

*Primary Examiner*—J. Franklin Foss
*Assistant Examiner*—Robert A. Olson
*Attorney, Agent, or Firm*—Jones, Day, Reavis & Pogue

[57] ABSTRACT

A support bracket is disclosed for signs and advertising displays used in retail stores. The invention is attached to a shelf support wall and permits height adjustment of the sign or display. The bracket consists of an adjustable clamping portion for engagement with the wall and a vertically disposed support for a display or sign.

1 Claim, 6 Drawing Figures

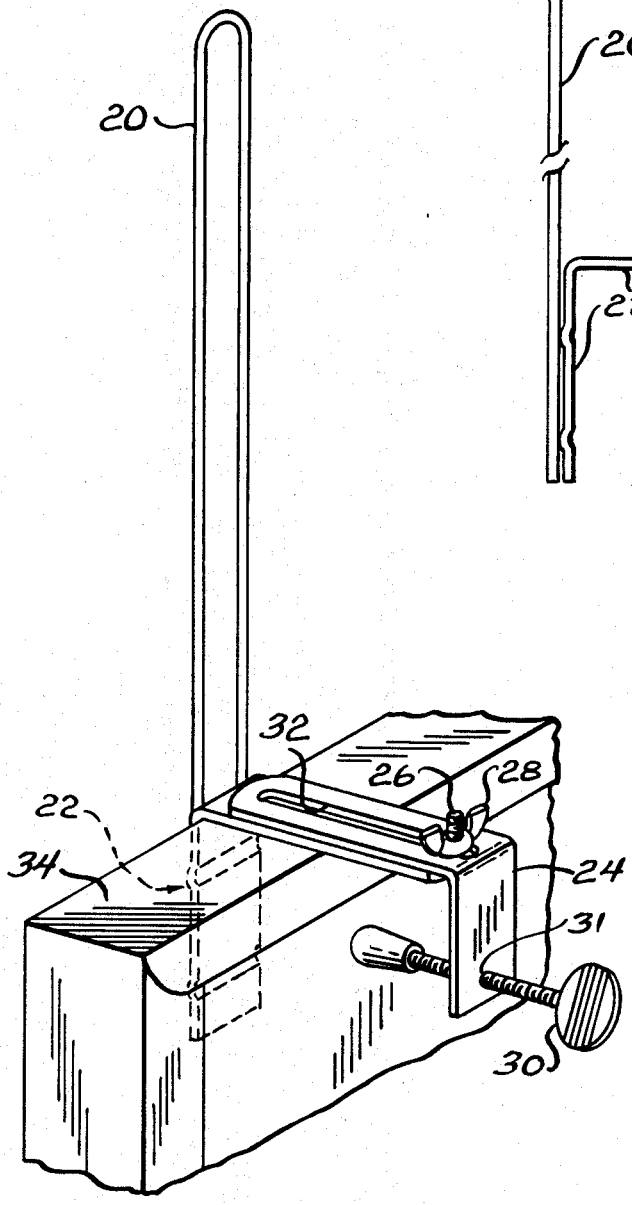
FIG. 1
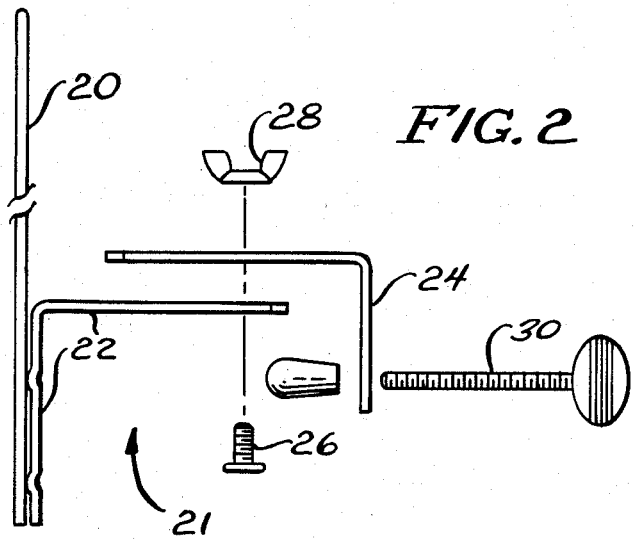
FIG. 2
FIG. 3
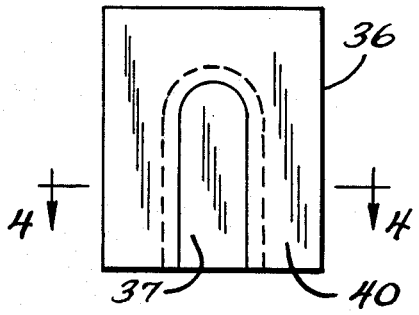
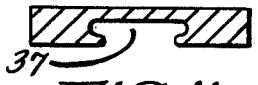
FIG. 4
FIG. 5
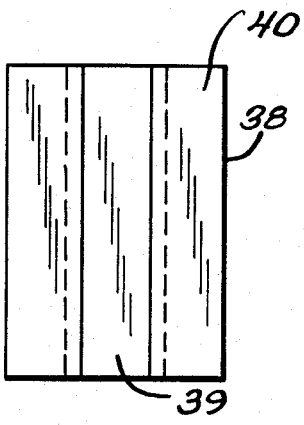
FIG. 6
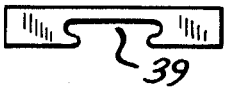

SUPPORT BRACKET FOR SIGNS AND ADVERTISING DISPLAYS

BACKGROUND OF THE INVENTION

This invention relates to support devices for signs, displays and the like. More specifically, it relates to a support device which permits height adjustment of various display signs used to advertise or identify merchandise on the top shelf of a divider (called a gondola) in a retail store, such as a supermarket.

Signs and advertising displays are used extensively in retail stores to identify and advertise the merchandise being sold. In such retail outlets merchandise is often stacked on shelves which are attached to a perforated support wall called a gondola. The perforations in the gondola allow the shelf heights to be adjusted as need requires. However, even with the ability to adjust shelf height, merchandise stacked on the top shelf may often exceed the height of the gondola, such as, where a substantial quantity of merchandise on the lower shelves leaves no room on the gondola to lower the height of the top shelf. In such situations, conventional display signs cannot be adjusted to maintain a preferred height above the merchandise. Likewise, the constant rearrangement of merchandise on the top shelf will often displace a conventional display out of position.

The present invention remedies the above problems. To compensate for the bulk or the height of merchandise on the top shelf, the present invention provides means by which the display height can be easily adjusted to maintain a preferred height above the merchandise. Attachment means are provided to attach the invention to the gondola so that the display will not be knocked out of position by the retailer's routine replacement and rearrangement of merchandise.

It is accordingly an object of the present invention to provide an improved support bracket for a sign or advertising display to be used in connection with the merchandise on the top shelf of a gondola.

It is another object of the invention to provide an improved support bracket which allows the height of the sign or display to be manually adjusted to maintain a preferred height above the merchandise on the top shelf of a gondola.

It is still another object of the invention to provide an improved support bracket which is reversibly attachable to gondolas of varying widths.

Other objects and advantages of the invention will be apparent from the remaining portion of the specification.

BRIEF DESCRIPTION OF THE DRAWINGS

FIG. 1 is a perspective view of the invention.

FIG. 2 is a perspective view of the invention mounted to a gondola.

FIGS. 3 and 4, 5 and 6 are perspective views of means for attaching the display signs to the invention.

DETAILED DESCRIPTION OF THE PREFERRED EMBODIMENT

Referring to FIGS. 1 and 2, a support bracket made in accordance with the teachings of the invention is illustrated. The support bracket includes a display support 20 which serves as a vertical support piece for a sign or display. The support 20 is preferably formed from a U-shaped wire loop but may also be composed of any other deformable material which will provide a spring-like friction fit with the sign attaching means to be described.

The support 20 is affixed to an adjustable clamp 21 for attaching the invention to a gondola. When attached to the gondola, the support bar 20 extends vertically above the top of the gondola. The clamp 21 consists of two L-shaped members 22 and 24. As shown in FIG. 2, the support 20 is affixed to member 22. The support 20 is preferably spot welded to member 22.

A slot 32 is provided in the L-shaped member 24 to permit adjustment of the bracket for different sized gondolas. A screw and wing nut combination 26 and 28 secure the member 24 over the member 22 at the desired bracket spacing. Readjustment is easily and quickly accomplished by loosening the nut, repositioning the member 24 relative to member 22 and retightening the nut 28.

Once the bracket is correctly sized for the gondola, it is mounted thereon. A thumb screw 30, or its equivalent, is employed and extends through a threaded hole 31 in the L-shaped member 24. Tightening the thumb screw clamps the bracket to the gondola by engaging member 22 and the end of the screw there-against.

Referring to FIGS. 3 and 4, two types of backings for signs or displays are ilustrated. Backing member 36 incorporates a pocket or groove 37 which extends through a limited portion of the height of the design. The groove or pocket is dimensioned to receive the upper portion of member 20 therein whereby a sign or display attached to the backing is supported for display on the gondola.

Adjustable backing member 38, shown in FIG. 4, incorporates a pocket or groove 39 which extends vertically along its entire length. Therefore, backing 38, when placed over the support 20, can be positioned at any point along the support 20.

Both backing designs 36 and 38 are dimensioned to fit snugly but slidably on the support 20. A spring-like friction fit is desired to simplify the height adjustment of the sign or display by eliminating the need for clamps or other fastening devices. This configuration allows the sign or display to be adjusted with little effort. Indeed, adjustment can be completed by simply pushing the display up or down on the support 20. The ease with which adjustment is completed is perhaps most apparent where the invention is located overhead and is hard to reach.

The signs or displays are secured to either of the backing members 36 or 38 by adhesively affixing the back of the sign or display to the backing member face 40.

While I have shown and described an embodiment of this invention in some detail, it will be understood that this description and illustration are offered merely by way of example, and that the scope of the invention is to be adjudged only by the appended claims and their equivalents.

What is claimed is:

1. A support bracket arrangement for securing signs and advertising displays to a vertically disposed shelf gondola comprising:

an adjustable clamp for securing the bracket to the gondola, said adjustable clamp comprising one L-shaped member secured over a second L-shaped member by a screw and wing nut combination with one of said L-shaped members having a slot to permit adjustment of the clamp to receive different sized gondolas, one of said one L-shaped members including a set screw positioned in a thread hole for engaging the gondola to secure the clamp thereagainst;

a verticaly extending support for securing a sign thereon, said support comprising an inverted U-shaped wire loop which extends vertically along its entire length above the gondola and is attached at its ends to the other of said L-shaped member;

a backing member attachable to a sign or display, said backing member comprising a channel having an inverted U-shaped portion dimensioned to snugly but slidably receive said inverted U-shaped wire loop such that said inverted U-shaped wire loop mateably engages said channel along said inverted U-shaped portion;

whereby a sign attached to said backing member can be supported for display above said gondola at a predetermined height by the engagement of said inverted U-shaped portion of said channel with said inverted U-shaped wire loop.

* * * * *